US006014977A

United States Patent [19]

Friedman

[11] Patent Number: 6,014,977

[45] Date of Patent: Jan. 18, 2000

[54] CURLING IRON WITH ADJUSTABLE BARREL

[76] Inventor: Donna K. Friedman, 8071 Oakdale, NW., Massillon, Ohio 44646

[21] Appl. No.: 09/337,769

[22] Filed: Jun. 22, 1999

Related U.S. Application Data

[60] Provisional application No. 60/090,328, Jun. 23, 1998.

[51] Int. Cl.[7] ..... A45D 1/04

[52] U.S. Cl. ..... 132/232; 132/225; 132/229; 219/222; 219/225

[58] Field of Search ..... 132/229, 231, 132/232, 234, 117, 118, 200, 271, 225, 224; 219/225, 222, 221, 227

[56] References Cited

U.S. PATENT DOCUMENTS 3,918,465 11/1975 Barradas ..... 132/37
3,921,648 11/1975 Barradas ..... 132/37
4,065,657 12/1977 Zusser ..... 219/225
4,209,685 6/1980 Walter et al. ..... 219/225
4,926,027 5/1990 Montagino et al. ..... 219/222

*Primary Examiner*—Gene Mancene
*Assistant Examiner*—Pedro Philogene
*Attorney, Agent, or Firm*—Sand & Sebolt

[57] ABSTRACT

A curling iron includes a handle that supports a heating element that projects out from the handle. An adjustable barrel is also carried by the handle and surrounds the heating element such that the heating element is substantially centrally disposed in the barrel. The barrel is adjustable between first and second positions where the diameter of the barrel is larger in the second position than the first position. The heating element remains centrally disposed in the barrel in the first and second positions. The barrel is adjusted by moving the clip assembly that is connected to the barrel. The clip assembly includes a clip that accommodates the changes in barrel diameter. A plurality of support elements are connected to the handle and adjustably support the barrel. The support elements include springs that support shoes that slidably engage the barrel.

19 Claims, 5 Drawing Sheets

CURLING IRON WITH ADJUSTABLE BARREL

CROSS REFERENCE TO RELATED APPLICATION

This application claims priority from copending Provisional Application Ser. No. 60/090,328, filed Jun. 23, 1998, the disclosures of which are incorporated herein by reference.

BACKGROUND OF THE INVENTION

1. Technical Field

The present invention generally relates to small household appliances and, more particularly, to a curling iron. Specifically, the present invention relates to a curling iron having a barrel having an adjustable diameter allowing the curling iron to be used to create an infinite number of curl sizes between a minimum and a maximum diameter.

2. Background Information

Individuals and hairstyling professionals use a curling iron to impart a curl in one's hair that typically does not occur naturally. A curling iron imparts a curl to a strand or a plurality of strands of hair by applying heat to the hair while the hair is held in the desired position. The desired position is typically a semicircular shape that is achieved by wrapping the hair about the outer surface of a heated cylindrical barrel. The barrel is typically fabricated from metal conducts heat to the hair. A clip is also provided adjacent the barrel to hold the hair against the barrel with sufficient force to cause the hair to acquire the shape of the barrel. The clip is curved along the radius of curvature of the barrel to ensure a tight fit between the clip and the barrel.

Curling irons presently known in the art have a single barrel diameter such that only one curl size may be achieved with a single curling iron. When the individual or hair care professional desires to create curls of different sizes, a different curling iron must be used. Purchasing multiple curling irons is undesirable given the increased cost of acquiring the additional curling irons and the extra storage space required to properly store the curling irons. It is thus desired in the art to provide a curling iron that has different barrel diameters that allow different-sized curls to be formed by a single curling iron.

Some curling irons known in the art allow the user to install attachments to the barrel that have different diameters to create different curl sizes. One drawback with such attachments is that the attachments are separate from the curling iron and must be separately stored creating yet further hair care elements that must be stored in a typically crowded space. Another drawback to such attachments is that the attachments are hot after they have been used and it is difficult and sometimes dangerous to remove the attachments when they are hot so that a different sized curl may be worked on. In addition to the danger of burning one's fingers while removing the attachment, the attachment must be properly and safely stored to prevent fires. It is thus desired in the art to provide a curling iron having a barrel that is adjustable so that different sized curls may be achieved without using removable attachments.

SUMMARY OF THE INVENTION

In view of the foregoing, it is an objective of the present invention to provide a curling iron having an adjustable barrel that allows different-sized curls to be formed with the curling iron.

Another objective of the present invention is to provide a curling iron having an adjustable barrel that does not use attachments to achieve different diameter curls.

Yet another objective of the present invention is to provide a curling iron having an adjustable barrel wherein the diameter of the barrel may be adjusted between a minimum and maximum diameter simply by turning an element of the curling iron.

Still another objective of the present invention is to provide a curling iron with an adjustable barrel that is designed to prevent hair from catching on the adjustable barrel during use.

A further objective of the present invention is to provide a curling iron with an adjustable barrel that has a clip that automatically adjusts with the diameter of the barrel.

Still a further objective of the present invention is to provide a curling iron with an adjustable barrel wherein the clip is rotated to achieve adjustment of the diameter of the barrel.

Still a further objective of the present invention is to provide a curling iron with an adjustable barrel having a clip that is constantly urged against the outer surface of the adjustable barrel by a spring.

An additional objective of the present invention is to provide a curling iron with an adjustable barrel wherein the heater element is centrally disposed within the adjustable barrel such that the heat applied to the adjustable barrel is evenly distributed.

Yet an additional objective of the present invention is to provide a curling iron having an adjustable barrel with an on/off switch having multiple heat positions.

Still another objective of the present invention is to provide a curling iron having an adjustable barrel including a power cord attached to the heater element on a swivel that prevents the cord from becoming twisted.

Still an additional objective of the present invention is to provide a curling iron having an adjustable barrel that is of simple construction, which achieves the stated objectives in a simple, effective an inexpensive manner, and which solves the problems and which satisfies the needs existing in the art.

These and other objectives of the present invention are achieved by a curling iron including a handle; a barrel mounted on the handle; a clip assembly connected to the barrel; the clip assembly and barrel movable between first and second positions; the barrel having a first diameter at the first position and a second diameter at the second position; and the first diameter being smaller than the second diameter.

Other objectives and advantages of the present invention are achieved by a curling iron including a handle; a heater connected to the handle; a barrel mounted on the handle; the barrel adjustable between first and second positions; the barrel having a first diameter in the first position and a second diameter in the second position; the first diameter being smaller than the second diameter; and the heater substantially centrally disposed in the barrel in the first and second positions.

Further objectives and advantages of the present invention are achieved by a method of adjusting the diameter of a curling iron barrel including the steps of providing a curling iron having a handle, an adjustable barrel and a clip connected to the barrel; and moving the clip with respect to the handle to change the diameter of the barrel.

BRIEF DESCRIPTION OF THE DRAWINGS

The preferred embodiments of the invention, illustrative of the best mode in which applicant contemplated applying the principles of the invention, are set forth in the following description and are shown in the drawings and are particularly and distinctly pointed out and set forth in the appended claims.

Similar numbers refer to similar elements throughout the specification.

DESCRIPTION OF THE PREFERRED EMBODIMENTS

Figure 1:
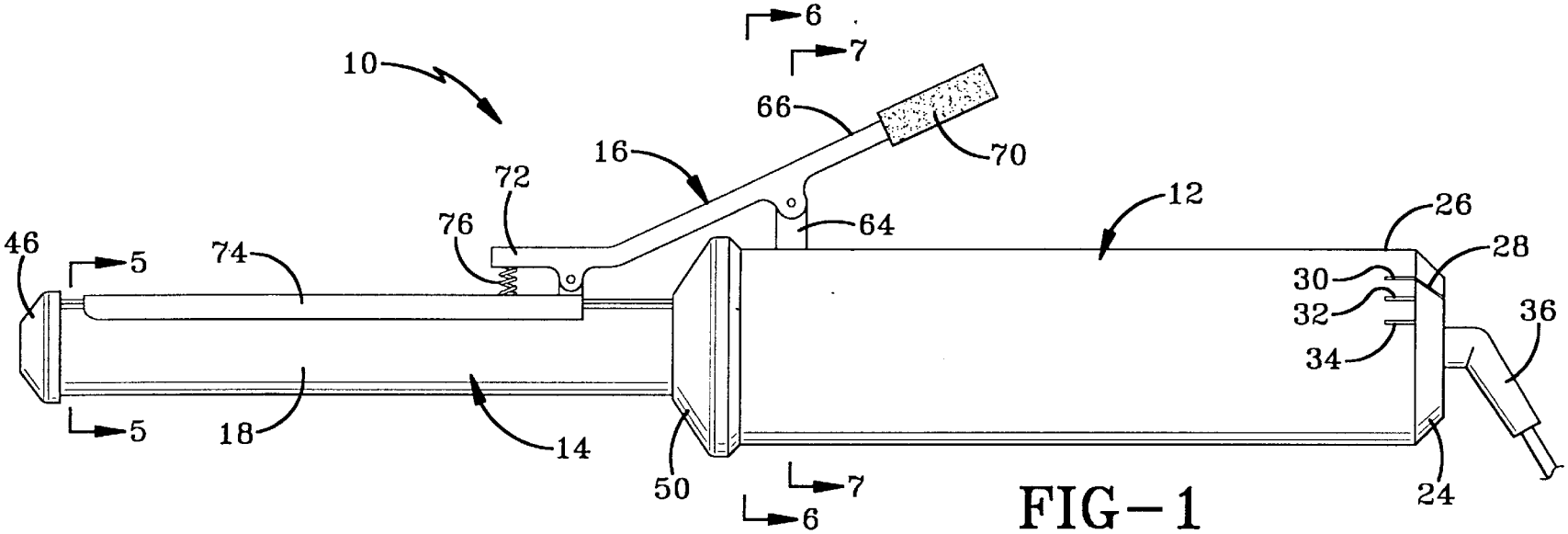
FIG. 1 is a side view of the curling iron of the present invention with the barrel in a retracted position.

The improved curling iron according to the present invention is depicted in the drawings and is indicated generally by the numeral 10. Curling iron 10 generally includes a handle 12, a barrel assembly 14, and a clip assembly 16. Curling iron 10 is configured and adapted to allow the user to adjust the diameter of the barrel 18 of barrel assembly 14 when clip assembly 16 is rotated with respect to handle 12. Such adjustment achieves one of the objectives of the present invention by allowing the user to use curling iron 10 to create different size curls with one tool.

Handle 12 is substantially cylindrical and may be fabricated from an appropriate plastic or metal. Handle 12 is also substantially hollow and receives the electric heating unit 20 securely within the handle chamber 22.

An on/off switch 24 abuts the rear end 26 of handle 12. Switch 24 may be carried by heating unit 20. Switch 24 is selectively rotated to selectively control heating unit 20. An indicating line 28 may be provided on switch 24 to show the user the position of switch 24 with respect to handle 12. Corresponding indicating lines 30, 32, and 34 may be provided on handle 12 to show the position of switch 24 in the off 30, intermediate/low heat setting 32, and on/high heat 34 positions. In other embodiments of the present invention, further settings may be provided depending on the type of heating unit 20 provided in curling iron 10. Switch 24 is connected to a power cord 36 with a swivel connector 38 that prevents power cord 36 from becoming twisted when curling iron 10 is turned while in use. Such swivel connector 38 may be any of the variety of swivel connectors known in the art.

Figure 4:
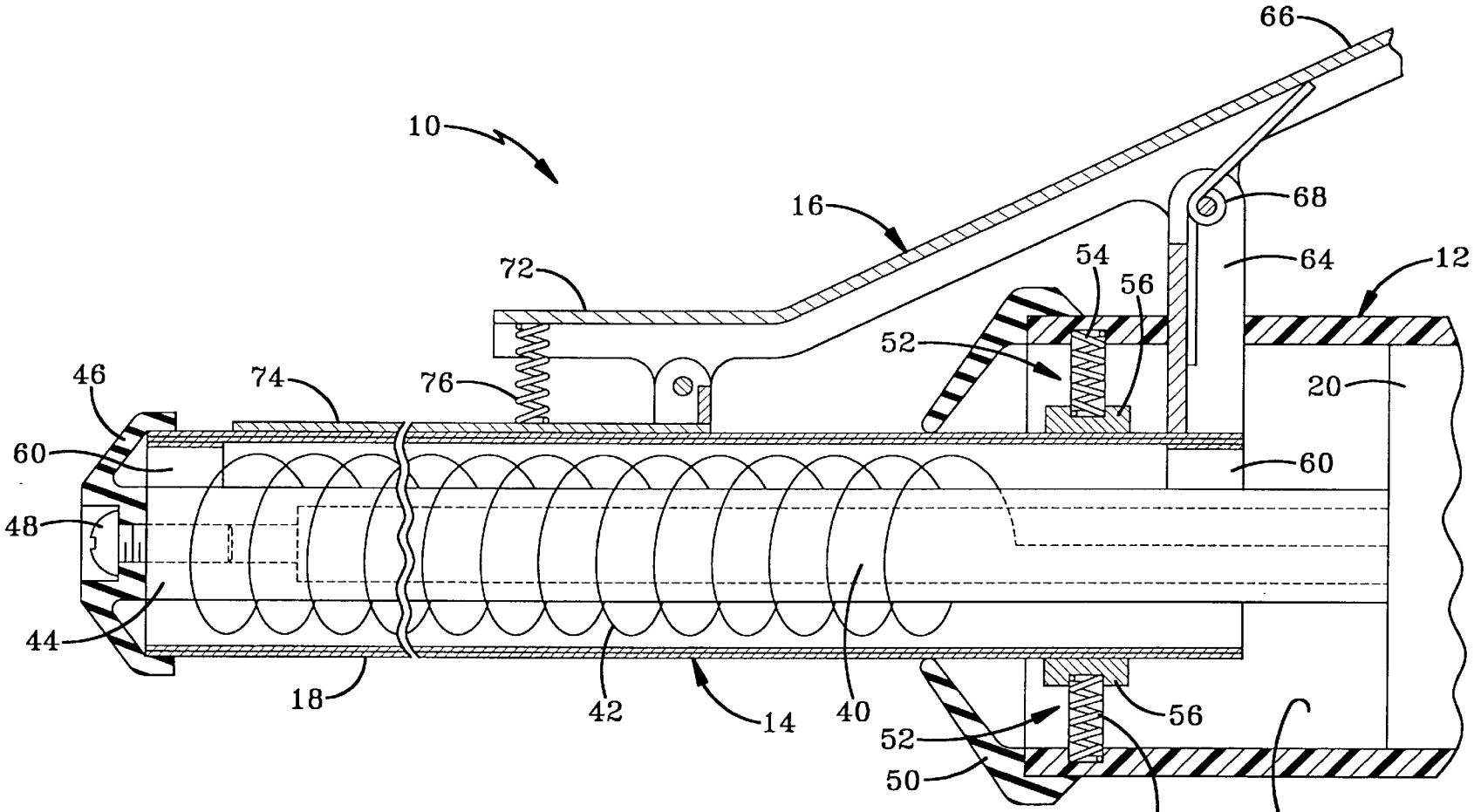
FIG. 4 is a sectional view of the curling iron taken along line 4—4 of FIG. 2.

As may be perhaps best seen in FIG. 4, heating element 20 includes a heater 40 that extends outwardly from heating element 20 through barrel 18. Heating element 20 and heater 40 may be any of the variety of heat producing devices known in the art that are suitable for producing heat for curling irons. In the embodiment of the invention depicted in the drawings, a heating wire 42 extends out of heater 40 and repeatedly encircles heater 40 throughout the length of barrel 18. In accordance with another objective of the present invention, heater 40 and heating wire 42 are centrally disposed within barrel 18 such that the heat created by heater 40 and heating wire 42 is evenly distributed to barrel 18.

The projecting end 44 of heater 40 carries an end flange 46 that protects and covers the end of barrel 18. Flange 46 may be connected to heater 40 by an appropriate connector 48 such as the bolt depicted in the drawings. Flange 46 is fabricated from a flexible material such as a suitable rubber or plastic that may expand and contract with barrel 18 as the diameter of barrel 18 is adjusted. Flange 46 protects the user of curling iron 10 by preventing the users hair from getting caught and tangled in barrel 18. Flange 46 also covers the relatively sharp end of barrel 18. A second flange 50 is provided between handle 12 and barrel 18. Flange 50 is also fabricated from a suitable rubber or plastic that is adapted to adjust when the diameter of barrel 18 is adjusted. Flange 50 protects the user in a similar manner as flange 46 by preventing the user's hair from becoming entangled within the interior of curling iron 10 and covers the relatively sharp end of handle 12.

Barrel assembly 14 includes barrel 18 and a plurality of support elements 52 that connect barrel 1 8 to handle 12 in an adjustable and accommodating manner. Each support assembly includes one or a plurality of springs 54 such as the coil springs depicted in the drawings that extend between the interior surface of handle 12 and a shoe 56 that slidably engages the outer surface of barrel 18. In the embodiment of the invention depicted in the drawings, four shoes 56 are used to provide a stable connection between barrel 18 and handle 12. Each shoe 56 is supported in an adjustable and accommodating manner from handle 12 by three coil springs 54. Each spring 54 has a spring strength that is sufficient to support barrel 18 in a manner such that it does not wobble with respect to handle 12. Similarly, each shoe 56 has a width that is sufficient to support barrel 18 in a stable manner.

Figure 6:
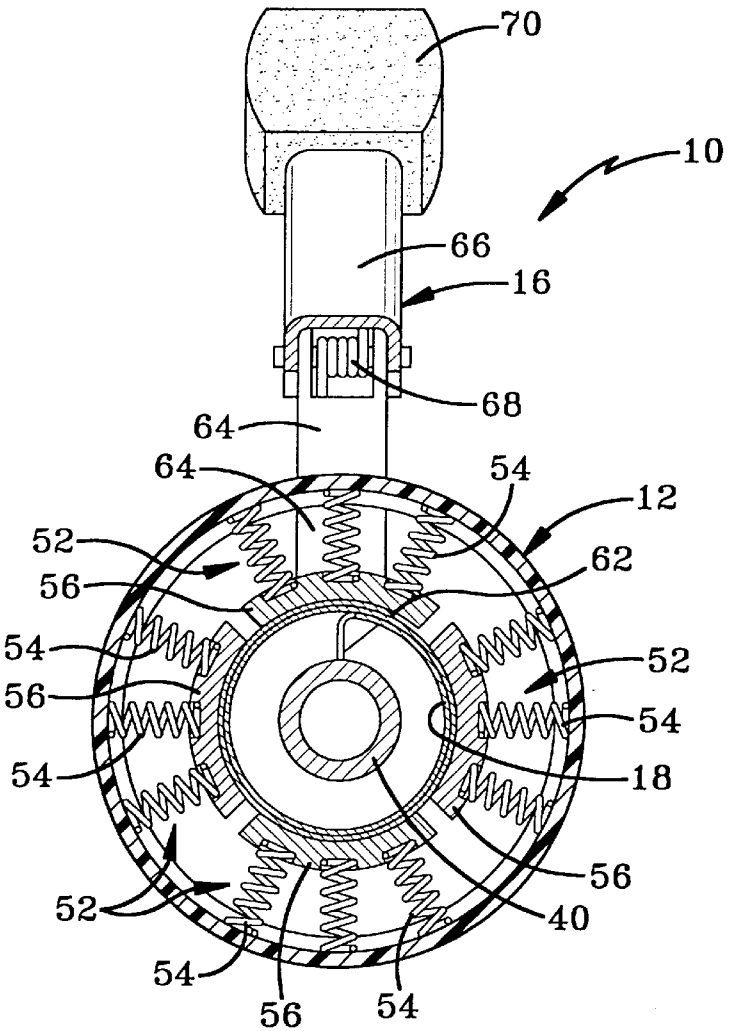
FIG. 6 is a sectional view taken along line 6—6 of FIG. 1.
Figure 5:
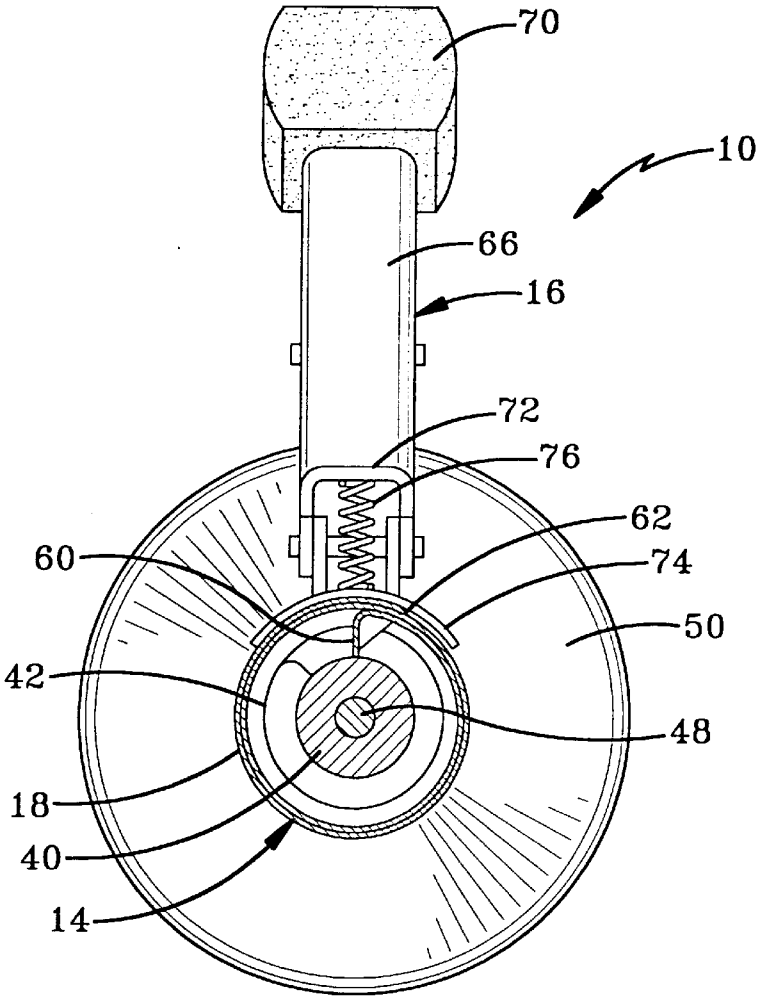
FIG. 5 is a sectional view taken along line 5—5 of FIG. 1.

Barrel 18 is fabricated from a material such as spring steel that conducts heat while also being capable of flexing when the diameter of barrel 18 is adjusted. Barrel 18 includes a first end 60 that may be anchored to heater 40 as depicted in FIGS. 5 and 6. Barrel 18 then extends around heater 40 slightly more than two complete rotations while resting against itself so that a spring is formed by barrel 18. The second end 62 of barrel 18 is tapered in a manner that prevents hair from catching in barrel 18 and prevents kinks from being formed in the hair when the hair is curled on barrel 18. The taper forms a smooth transition between second end 62 and the body of barrel 18.

Figure 1A:
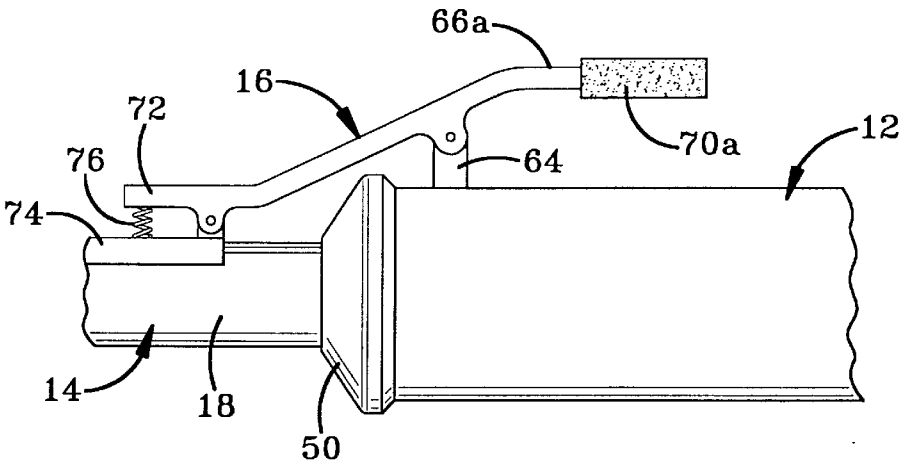
FIG. 1*a* is a side view of an alternative embodiment of the thumb lever.
Figure 3:
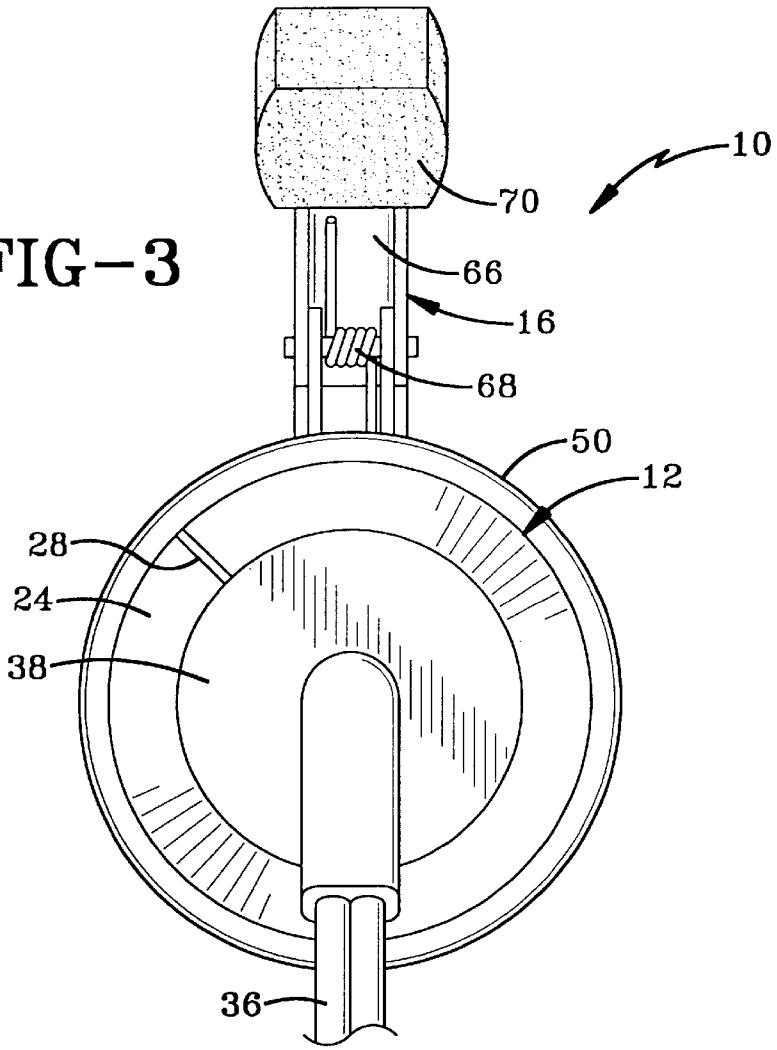
FIG. 3 is an end view of the curling iron taken from the end opposite of FIG. 2.
Figure 2:
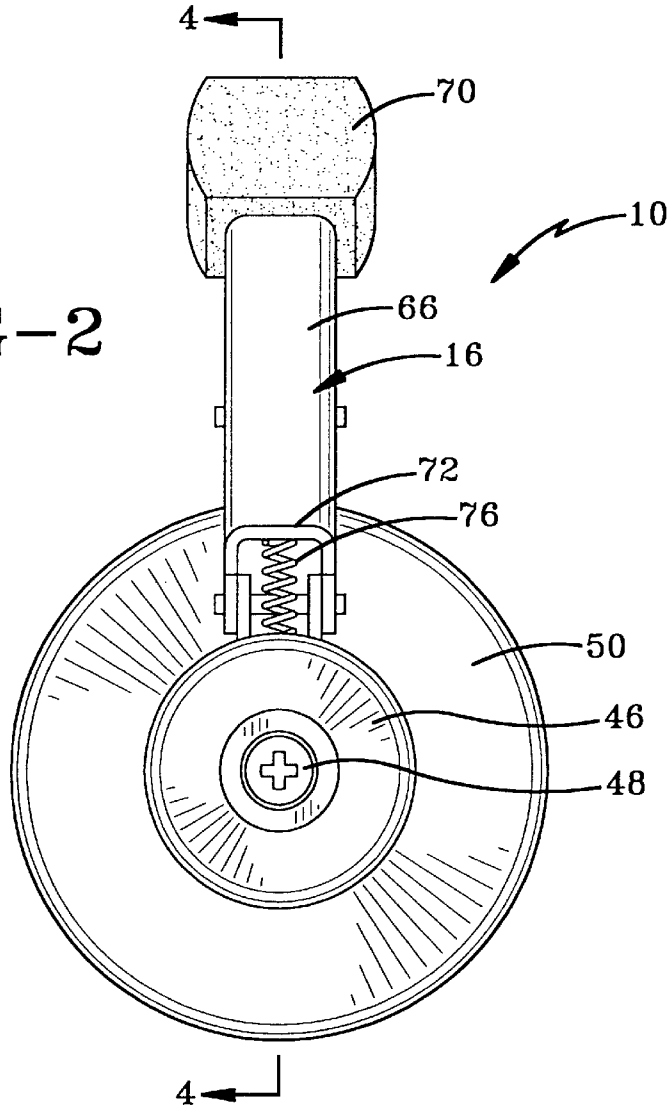
FIG. 2 is an end view of the curling iron.

Clip assembly 16 is connected to the outer surface of barrel 18 in a manner that allows the diameter of barrel 18 to be adjusted when clip assembly 16 is rotated with respect to handle. This configuration achieves another of the objectives of the present invention by providing for easy adjustment of the diameter of barrel 18. Clip assembly 16 includes a support 64 that is connected to the outer surface of barrel 18 and extends through a slot 65 in handle 12. Rotation of support 64 with respect to handle 12 causes barrel 18 to rotate with respect to itself with such rotation causing the diameter of barrel to adjust because first end 60 is anchored to heater 40. Clip assembly 16 further includes a thumb lever 66 that is pivotly connected to support 64. Thumb lever 66 is urged to a resting position by a spring 68 that extends between support 64 and thumb lever 66. Thumb lever 66 may include a thumb tab 70 that provides a secure grip for the user on thumb lever 66. In another embodiment of the present invention that is depicted in FIG. 1*a*, thumb lever 66*a* is bent such that thumb tab 70*a* is substantially parallel to handle 12. Such a configuration allows for ease of use for people who have smaller hands.

The lower end 72 of thumb lever 66 extends substantially parallel to barrel 18 and is pivotly connected to a clip 74 that slidably engages barrel 18 and extends over substantially the entire length of barrel 18. Clip 74 may also be urged against barrel 18 by an appropriate spring 76. Spring 76 may not be included in alternative embodiments of the present invention. Clip 74 is adjustable such that it accommodates the change in diameter of barrel 18 by flexing to change its radius of curvature as may be perhaps best seen by comparing the radius of curvature of clip 74 in FIGS. 5 and 8. This adjustment may be achieved by fabricating clip 74 from an appropriate material such as a flexible metal. Clip 74 is also configured to withstand the relatively high heat produced by heater 40 and heating wire 42 and transmitted through barrel 18. The adjustable and accommodating clip 74 thus achieves another of the objectives of the present invention.

Figure 8:
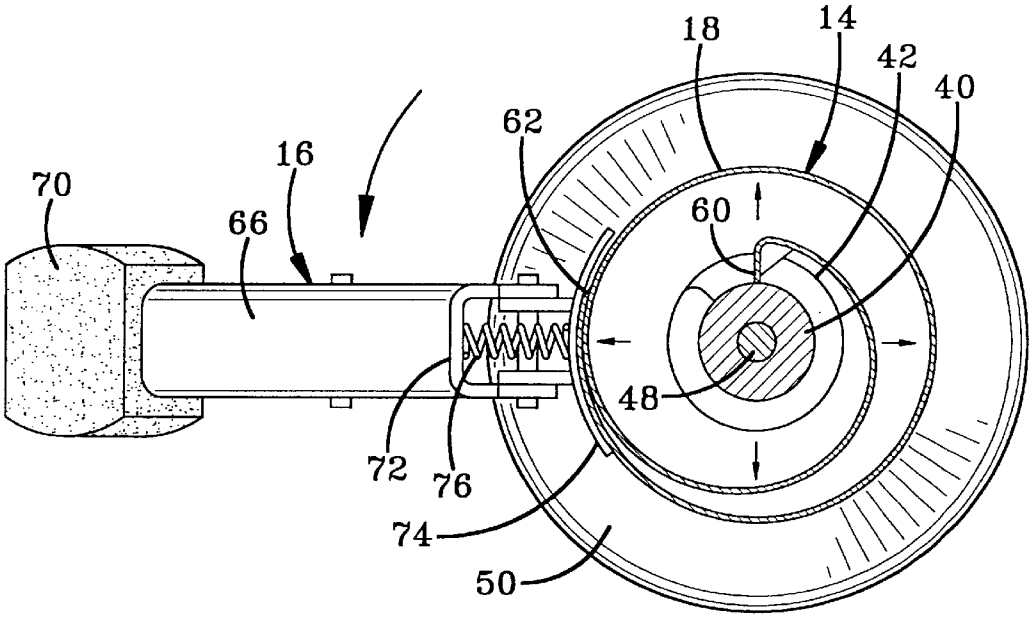
FIG. 8 is a view similar to FIG. 7 with the clip assembly rotated and the barrel in an expanded position.
Figure 7:
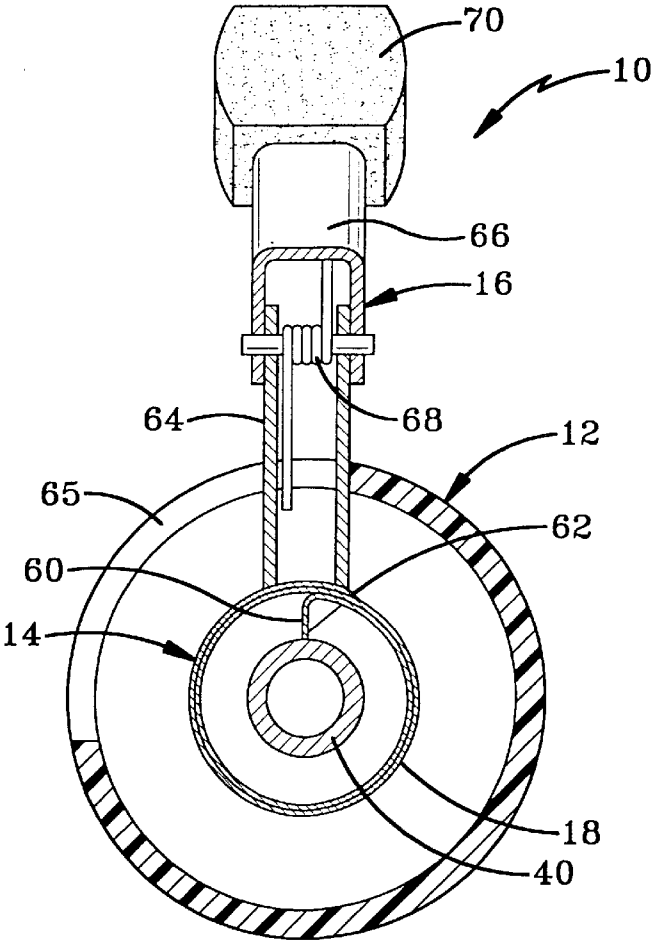
FIG. 7 is a sectional view taken along line 7—7 of FIG. 1.

Having now described the structure of curling iron 10, the operation of curling iron 10 will now be described. Curling iron 10 is operated by plugging s power cord 36 into a standard wall outlet. This provides power to heating element 20 which causes heater 40 and heating wire 42 to heat up transmitting heat to barrel 18. Once heater 40 and heating wire 42 have fully heated barrel 18, the user may use curling iron 10 to create curls in the user's hair. Such use is typically accomplished by wrapping strands of hair about barrel 18 and holding the hair against barrel 18 by clip 74. When the user desires a curl of a different diameter, the user rotates clip assembly 16 as depicted in FIG. 8. Such rotation causes clip assembly 16 to rotate with respect to handle 12 causing a portion of barrel 18 to rotate with clip assembly 16. When this occurs, barrel 18 expands outwardly because first end 60 of barrel 18 is anchored. As depicted in FIG. 8, the diameter of barrel 18 expands as clip assembly 16 is rotated to allow the user to create curls of a different diameter. As the diameter of barrel 18 adjusts, clip 74 also flexes to remain adjacent to the outer surface of barrel 18. The friction between flange 50 and barrel 18 may be sufficient to prevent barrel 18 from springing back to the initial position depicted in FIG. 7. When such friction is not sufficient, stops, catches, or clips may be provided in slot 66 to prevent barrel 18 from adjusting once its diameter is set. In another embodiment of the present invention, the friction between slot 66 and support 64 maintains the diameter of barrel 18.

When the diameter of barrel 18 is adjusted, springs 54 accommodate the adjustment by compressing or expanding and allowing shoes 56 to move radially inwardly or outwardly. Similarly, flanges 46 and 50 adjust as the diameter of barrel 18 is adjusted. It may be seen in FIG. 8 that heater 40 and heating wire 42 remain substantially centrally disposed within barrel 18 as the diameter of barrel 18 is adjusted. Such location provides for the even distribution of heat from heater 40 and heating wire 42 to barrel 18. The even distribution of heat achieves yet another objective of the present invention.

Accordingly, the improved curling iron with adjustable barrel is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the curling iron with adjustable barrel is constructed and used, the characteristics of the construction, and the advantageous new and useful results obtained; the new and useful structures, devices, elements, arrangements, parts, and combinations are set forth in the appended claims.

I claim:

1. A curling iron comprising:

a handle;

a barrel mounted on the handle;

a clip assembly connected to the barrel;

the clip assembly and barrel movable between first and second positions;

the barrel having a first diameter at the first position and a second diameter at the second position; and the first diameter being smaller than the second diameter.

2. The curling iron of claim 1, further comprising a heater at least partially disposed within the barrel.

3. The curling iron of claim 2, further comprising a switch in communication with the heater; the switch selectively movable between at least two positions to control the heater.

4. The curling iron of claim 3, further comprising a power cord and a swivel connector; the swivel connector attaching the power cord to the switch.

5. The curling iron of claim 1, wherein the barrel includes a first end and a second end with the material of the barrel completing at least two rotations to form a substantially cylindrical barrel.

6. The curling iron of claim 5, wherein the first end of the barrel is anchored.

7. The curling iron of claim 5, wherein the second end of the barrel is tapered and lays against the barrel.

8. The curling iron of claim 1, further comprising a flange disposed between the handle and the barrel.

9. The curling iron of claim 1, wherein the barrel has a projecting end; the curling iron further comprising a flange covering the projecting end of the barrel.

10. The curling iron of claim 1, further comprising at least one spring carried by the handle; the spring supporting the barrel.

11. The curling iron of claim 1, further comprising support elements carried by the handle; the support elements supporting the barrel in an accommodating manner.

12. The curling iron of claim 11, wherein each support element includes a spring connected to a shoe; the shoe abutting the barrel.

13. The curling iron of claim 1, wherein the clip assembly includes a support connected to the barrel.

14. The curling iron of claim 13, wherein the handle has a slot, the support extending through the slot in the handle.

15. The curling iron of claim 13, wherein the clip assembly includes a clip that rests against the barrel; the clip being flexible to accommodate changes in barrel diameter.

16. A curling iron comprising:

a handle;

a heater connected to the handle;

a barrel mounted on the handle;

the barrel adjustable between first and second positions;

the barrel having a first diameter in the first position and a second diameter in the second position; the first diameter being smaller than the second diameter; and the heater substantially centrally disposed in the barrel in the first and second positions.

17. The curling iron of claim 16, further comprising a heating wire in communication with the heater; the heating wire encircling the heater.

18. A method of adjusting the diameter of a curling iron barrel comprising the steps of:

providing a curling iron having a handle, an adjustable barrel, and a clip connected to the barrel; and moving the clip with respect to the handle to change the diameter of the barrel.

19. The method of claim 18, wherein the step of moving includes the step of rotating the clip about the longitudinal axis of the barrel.

* * * * *